United States Patent [19]

Braatvedt

[11] Patent Number: 4,619,558

[45] Date of Patent: Oct. 28, 1986

[54] APPARATUS FOR PRODUCING IN-SITU CONCRETED PILES WITH ENLARGED BASES

[75] Inventor: Ian H. Braatvedt, Liege, Belgium

[73] Assignee: Compagnie Internationale des Pieux Armes Frankignoul, Liege, Belgium

[21] Appl. No.: 763,816

[22] Filed: Aug. 8, 1985

Related U.S. Application Data

[62] Division of Ser. No. 545,946, Oct. 27, 1983, Pat. No. 4,544,515.

[30] Foreign Application Priority Data

Nov. 5, 1982 [GB] United Kingdom ..... 8231681

[51] Int. Cl.[4] ..... E02D 5/44

[52] U.S. Cl. ..... 405/237; 405/242; 405/243

[58] Field of Search ..... 405/233, 235, 236, 237, 405/238, 240, 242, 243

[56] References Cited

U.S. PATENT DOCUMENTS

| | | | |
|---|---|---|---|
| 1,477,567 | 12/1923 | Lancaster | 405/243 |
| 1,858,204 | 5/1932 | Frankignoul | 405/242 |
| 2,649,694 | 8/1953 | Pickman | 405/240 |
| 3,206,935 | 9/1965 | Phares | 405/243 |
| 3,512,365 | 5/1970 | Muller | 405/243 |
| 3,568,452 | 3/1971 | Stifler | 405/237 |
| 3,851,485 | 12/1974 | Steding | 405/233 |
| 4,012,915 | 3/1977 | Poma | 405/243 |
| 4,158,518 | 6/1979 | Rusche | 405/240 |

FOREIGN PATENT DOCUMENTS

| | | | |
|---|---|---|---|
| 1110092 | 6/1961 | Fed. Rep. of Germany | 405/242 |
| 2217485 | 8/1973 | Fed. Rep. of Germany | 405/233 |
| 470806 | 10/1914 | France | 405/242 |
| 862630 | 3/1961 | United Kingdom . | |
| 898635 | 6/1962 | United Kingdom . | |
| 1361182 | 7/1974 | United Kingdom . | |
| 1376460 | 12/1974 | United Kingdom . | |

*Primary Examiner*—David H. Corbin

*Attorney, Agent, or Firm*—Brumbaugh, Graves, Donohue & Raymond

[57] ABSTRACT

An apparatus for producing a concrete pile in the ground with an enlarged base, including a tube having a diameter, and an upper and a lower end, a shoe provided at the lower end of the tube and having a larger diameter than the tube so as to form a gap between the tube and the ground, a longitudinal outer casing having a diameter substantially equal to the shoe diameter so as to define a space between the tube and the outer casing, the casing also having a lower end attached to the shoe, and an open upper end so as to allow a free flow of concrete into the space between the tube and the outer casing, a sliding joint provided so as to slidably attach the outer casing to the tube so that a predetermined length of sliding exists between the tube and the outer casing, a pile having a free-falling hammer, the tube, with the outer casing attached, being drivable into the ground by the pile to a depth greater than the length of the outer casing so as to form an opening in the ground and define the gap between the tube and the ground, means for supplying concrete to the gap and the space so that the gap and the space are filled with concrete as the tube with the attached outer casing is driven into the ground, means for expelling the shoe from the lower end of the tube and the outer casing, along with some of the concrete, so as to form the enlarged base, and a traction cable attached to the upper end of the tube so that the tube is raiseable from the shoe after the enlarged base is formed so as to cause the tube to slide upwardly with respect to the outer casing, thereby allowing concrete from the space to enter the volume of space previously occupied by the lower end of the tube, the tube being raised to a point where both the tube and the outer casing are removed from the ground so that the concrete from the gap and the space fills the resulting opening.

5 Claims, 4 Drawing Figures

APPARATUS FOR PRODUCING IN-SITU CONCRETED PILES WITH ENLARGED BASES

This application is a division of application Ser. No. 545,946, filed on Oct. 27, 1983 now U.S. Pat. No. 4,544,515 issued Oct. 1, 1985.

The invention essentially relates to an apparatus for producing in-situ concreted piles with enlarged bases cast in the ground of the type wherein a tube is driven into the ground together with a shoe and a plug, an enlarged base is formed and concrete is cast within the tube.

An apparatus is already known in the prior art to drive a tube into the ground by means of hammer of a pile driver and to form an enlarged base by expelling a plug of concrete or other resistant materials out of the lower end of the tube. When the enlarged base is of sufficient size and the surrounding material has been sufficiently compacted to support the required load, steel reinforcement and concrete are placed in the tube and the tube is extracted concurrent with certain vibratory forces or direct blows being applied to the tube. This ensures denseness of the concrete which occupies the space vacated by the tube as it is extracted. In this method and apparatus, the extraction of the tube is very difficult due to the forces and pressure applied by the soil against the tube. Moreover, it requires the use of a tube of the same diameter as the desired diameter of pile.

It is an object of this invention to provide an apparatus for producing a concrete pile cast in the ground which overcomes all these drawbacks.

For this purpose, the present invention provides an apparatus for producing a concrete pile with an enlarged base cast in the ground cavity, consisting of means, for example an automative pile driver having a free-falling hammer, for driving a tube into the ground the tube being provided at its lower end with a shoe and a plug of concrete or other resistant materials, when said shoe has reached the material in which the enlarged base is to be formed, the shoe and the plug are expelled by successive blows of a hammer to form said enlarged base, the tube is filled with fresh concrete by concrete supply means and extracted, the inventions characterized in that a gap is formed between the soil and the tube by driving into the ground said shoe which is larger than the diameter of said tube, fresh concrete is filled in said gap as fast as this gap is formed, and after the enlarged base is formed, the tube is lifted by traction cable means attached to the upper end of the tube to allow fresh concrete to enter into the tube through its lower end, and the tube is extracted while concrete is filled in said gap to always maintain the gap filled.

According to another characteristic of the invention, the tube is driven into the ground by successive blows of said hammer on said plug, and when the shoe has reached said material in which the enlarged base is to be formed, the plug and the shoe are expelled by successive blows of the hammer while the tube is maintained at a constant level by means of traction cables attached to its upper end.

According to another characteristic of the invention, an outer casing is attached to said tube, around the lower part thereof, said casing has a diameter substantially equal to the size of said shoe.

Advantageously, said outer casing is attached to the tube with a sliding joint to permit the tube to be lifted ahead of the outer casing in order to allow concrete to enter into the tube. This outer casing has a length equal to four times the diameter of the shoe.

Other characterizing features, advantages and details will appear more clearly from the following description made with reference to the appended drawings given solely by way of example and wherein.

Figure 1:
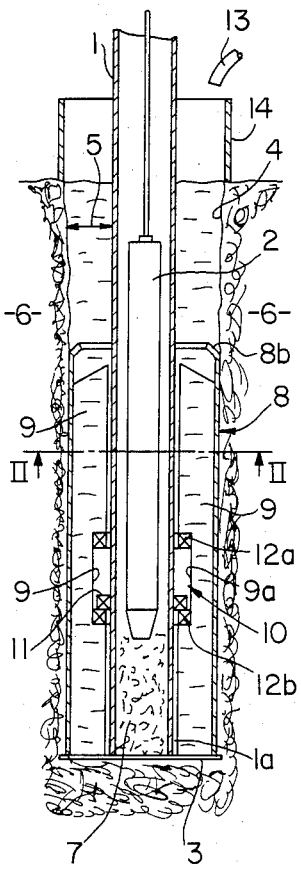
FIG. 1 is a diagrammatical view in section of the apparatus of the invention during the driving of the tube into the ground, the pile driver being not illustrated.
Figure 2:
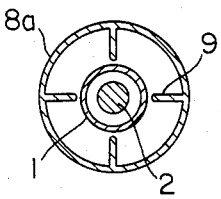
FIG. 2 is a view in section according to line II—II of the FIG. 1.

The apparatus diagrammatically illustrated in FIGS. 1, 2 comprises a tube 1, a free-falling hammer 2 which is in the tube 1. This hammer 2 is advantageous supported and actuated by an automotive pile driver (not illustrated).

To the lower end 1*a* of the tube 1 is attached a shoe 3. This shoe can be in the shape of a disc or a point or other shapes.

According to the invention, the size, such as for example the diameter, of the shoe 3 is larger than the diameter of tube 1. Therefore, when the tube is driven into the ground to form the opening 4, a gap 5 is formed between the tube 1 and the soil 6.

Prior to boring of the pile casting hole, the tube 1 has its lower end fitted with a substantially hermetic sealing plug 7 which is inserted into the lower extremity of the tube 1. This plug may consist of concrete or other resistant materials such as wood, metal or the like.

According to the preferred embodiment of the invention, an outer casing 8 is attaached to the tube 1 around the lower portion thereof. This casing is a cylindrical tube 8*a* of a diameter substantially equal to the diameter of the shoe 3 and provided with, for example, four vertical internal bars or plates 9 as illustrated in FIG. 2.

This outer casing 8 is attached to the tube 1 through a sliding joint 10. This sliding joint 10 is formed by notches 9*a* provided on each bar 9 and an annular ring 11 fixed around the tube 1. The annular ring 11 can slide within the notches 9*l* of bars 9. Moreover, each notch 9*a* is provided, on each lateral edge, with an annular ring 12*a*, 12*b*.

Advantageously, the upper end of the outer casing 8 is provided with an inward flange 8*b*.

Of course, the number of rings, the structure of the sliding joint are given solely for example.

Figure 3:
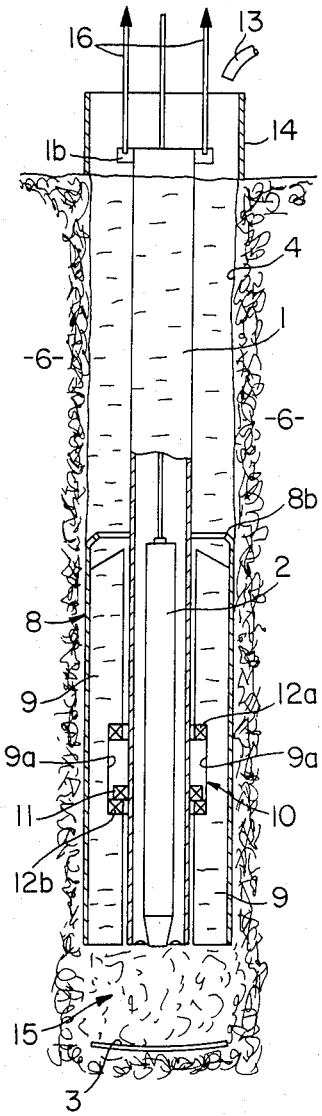
FIG. 3 is a view analogous to that of FIG. 1, showing the cast pile during the formation of the enlarged base.
Figure 4:
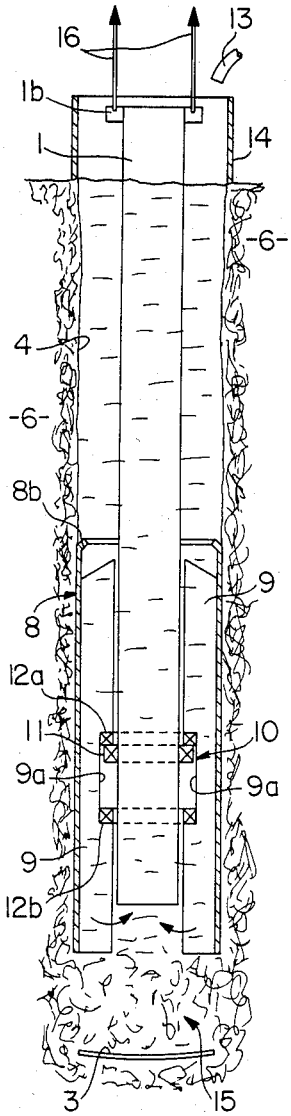
FIG. 4 is a view analogous to that of FIG. 1 or 3 showing the final stage in the production of the cast pile of the invention, and more particularly the extraction of the tube.

Referring to FIGS. 1, 3 and 4, the method of using the inventive apparatus for producing in-situ a concreted pile with an enlarged base, is now explained.

The tube 1 with the shoe 3, the plug 7 and the outer casing 8 is driven into the ground by successive blows of the hammer 2 on the plug 7, the plug being controlled by, for example, an automative pile driver.

During the driving of the tube into the ground, the opening 4 is formed and also the gap 5 between the tube 1 and the soil 6 or the outer casing 8.

According to the invention, this gap is filled with fresh concrete as fast as this gap is formed by supplying means 13. Consequently, since the gap 5 is always full with fresh concrete, this fact prevents caving in the walls of the opening 4 if it is formed in unstable ground.

It is important, during the driving of the tube 1 into the ground, that the fresh concrete supplied into the gap 5 cannot flow into the tube 1.

In the preferred embodiment of the invention, a temporary casing 14 is placed on the ground around the opening 4 to permit a suitable supplying of fresh concrete in the gap 5 from the supplying means 13.

Furthermore, it is judicious to maintain substantially constant, the level of fresh concrete in the gap 5 in order to maintain this gap entirely filled. The outer casing 8 is provided to prevent the "necking" or the reduction of shaft diameter which occurs in accordance with well known geotechnical principles during the forming of the opening in the ground. More preferably, the length of this outer casing is equal to four times the diameter of the shoe 3.

The further stage of using the invention, illustrated in FIG. 3, consists in forming the enlarged base 15 of the pile.

When the shoe 3 has reached the material in which the enlarged base 15 is to be formed, the tube 1 is maintained in position by means of traction cable 16 attached to its upper end 1*b* and preferably actuated by the pile driver. Then, the shoe 3 and the plug 7 is expelled and compacted by successive blows of the hammer 2. This compacting of the plug 7 is a result of compacting the soil around the base of the tube 1. A widened base of the pile which is to be formed, is thus produced and this widened base being formed by compacted concrete or other resistant materials which is itself placed in a rammed and compacted area of the soil.

FIG. 4 illustrates the following stage of using the present invention. In this stage, the hammer is at first withdrawn and a metal reinforcement (not illustrated) may be placed within the tube 1.

The tube 1 is then lifted ahead of the outer casing 8 by sliding of the annular ring 11 in the notch 9*a* to allow fresh concrete contained in the gap 5 to enter through the bottom of the tube 1 and fill this tube 1. Of course, fresh concrete is continuously supplied into the gap 5, by supplying mesns, to maintain substantially constant, the level of the concrete in the gap 5.

The tube is further extracted from the ground by means of traction cables 16 together with the associated outer casing 8 to form the pile.

Since the tube 1 is entirely contained in a fresh concrete, thus, the extraction of this tube requires reduced forces.

Besides, the use of a shoe which is larger than the diameter of the tube 1 permits the use of a tube of small diameter. The filling of the gap 5 with fresh concrete during the driving of the tube into the ground and the formation of the enlarged base, and the use of an outer casing prevent caving in the walls of the opening, "necking" and reduction of shaft diameter.

What we claim is:

1. An apparatus for producing a concrete pile in the ground with an enlarged base, comprising: a tube having a diameter, an upper end and a lower end; a shoe provided at said lower end of said tube and having a larger diameter than said tube so as to form a gap between said tube and the ground; a longitudinal outer casing fitable over said tube, and having a diameter substantially equal to said shoe diameter so as to define a space between said tube and said outer casing, said casing also having a lower end attached to said shoe, and an open upper end formed so as to allow a free flow of concrete into said space between said tube and said outer casing; a sliding joint provided so as to slidably attach said outer casing to said tube so that a predetermined length of sliding exists between said tube and said outer casing; a pile having a free-falling hammer, said tube, with said outer casing attached, being drivable into the ground by said pile to a depth greater than the length of said outer casing so as to form an opening in the ground and define said gap between said tube and the ground; means for supplying concrete to said gap and said space so that said gap and said space are fillable with concrete as said tube with said attached outer casing is driven into the ground; means for expelling said shoe from said lower end of said tube and said outer casing, along with some of the concrete, so as to form the enlarged base; and a traction cable attached to said upper end of said tube so that said tube is raiseable from said shoe after the enlarged base is formed so as to cause said tube to slide upwardly with respect to said outer casing, thereby allowing concrete from said space to enter the volume of space previously occupied by the lower end of said tube, said tube being raiseable to a point where both said tube and said outer casing are removable from the ground so that the concrete from said gap and said space fills the resulting opening.

2. An apparatus as defined in claim 1, wherein said length of said outer casing is approximately four times said shoe diameter.

3. An apparatus as defined in claim 1, wherein said outer casing is formed as a cylindrical tube, said sliding joint including a plurality of vertical inwardly projecting bars provided in said outer casing tube, each of said bars being provided with an inwardly facing notch, and an annular ring means fixed externally around said tube so as to be slidable, within said notches of said bars.

4. An apparatus as defined in claim 3, wherein each said notch is defined by lateral edges, said annular ring means including an annular ring provided on each of said lateral edges of each said notch.

5. An apparatus as defined in claim 1 and further comprising an inward flange provided on said upper end of said outer casing.

* * * * *